US005297688A

United States Patent [19]

Beck et al.

[11] Patent Number: 5,297,688

[45] Date of Patent: Mar. 29, 1994

[54] CLOSURE FOR SEALING A CONTAINER RIM

[75] Inventors: James M. Beck, Carol Stream; Terry E. Kubitz, Cary; Alex Kutaj, Vernon Hills, all of Ill.

[73] Assignee: Creative Packaging Corp., Buffalo Grove, Ill.

[21] Appl. No.: 992,136

[22] Filed: Dec. 17, 1992

Related U.S. Application Data

[63] Continuation-in-part of Ser. No. 845,373, Mar. 3, 1992, abandoned.

[51] Int. Cl.[5] ..... B65D 53/00

[52] U.S. Cl. ..... 215/344; 215/343; 215/354; 215/DIG. 1

[58] Field of Search ..... 215/341, 344, 343, 354, 215/DIG. 1

[56] References Cited

U.S. PATENT DOCUMENTS

| | | | |
|---|---|---|---|
| 3,074.579 | 1/1963 | Miller | 215/344 |
| 3,532,244 | 10/1970 | Yates, Jr. | 215/344 X |
| 3,568,871 | 3/1971 | Livingstone | 215/344 |
| 3,881,627 | 5/1975 | Davolt | 215/329 |
| 4,122,965 | 10/1978 | Roy . | |
| 4,143,785 | 3/1979 | Ferrell | 215/270 |
| 4,220,250 | 9/1980 | Brownbill . | |
| 4,308,965 | 1/1982 | Dutt | 215/345 |
| 4,360,114 | 11/1982 | Owens . | |
| 4,379,512 | 4/1983 | Ohmi et al. | 215/327 |
| 4,442,947 | 4/1984 | Banich, Sr. | 215/344 |
| 4,489,845 | 12/1984 | Aichinger et al. | 215/329 |
| 4,560,077 | 12/1985 | Dutt | 215/307 |
| 4,741,447 | 5/1988 | John . | |
| 4,878,589 | 11/1989 | Webster et al. . | |
| 4,907,709 | 3/1990 | Abe et al. | 215/252 |
| 4,984,701 | 1/1991 | Margaria . | |

FOREIGN PATENT DOCUMENTS

| | | | |
|---|---|---|---|
| 1782178 | 6/1978 | Fed. Rep. of Germany | 215/344 |
| 564461 | 7/1975 | Switzerland | 215/344 |

*Primary Examiner*—Allan N. Shoap
*Assistant Examiner*—Vanessa Caretto
*Attorney, Agent, or Firm*—Silverman, Cass & Singer, Ltd.

[57] ABSTRACT

A closure for sealing a rim of an open mouth of a container including a substantially cylindrical end cap closed at a first end thereof by a top surface, open at a second opposite end thereof and including an annular side wall having a predetermined width extending between the first and second ends, the top surface including a first inside surface facing the interior of the end cap and a second exterior surface facing the exterior of the end cap, a first flexible seal member connected to and depending a predetermined distance from the first inside surface of the top surface proximate the annular side wall for cooperative sealing engagement with an outer edge of the container rim and for inhibiting outward distortion of the container rim, and a second flexible seal member connected to and depending a predetermined distance from the first inside surface of the top surface and within the confines of the first seal member for sealing engagement with an inner edge of the container rim and for inhibiting inward distortion of the container rim, the rim substantially being accepted between the first and second seal members which seal the exterior and interior edges of the rim, respectively, to prevent leakage of the container contents and contamination of the contents from elements outside the container.

11 Claims, 2 Drawing Sheets

CLOSURE FOR SEALING A CONTAINER RIM

This application is a continuation-in-part of application No. 07/845,373 filed Mar. 3, 1992, now abandoned, which is owned by the same assignee as the assignee herein.

BACKGROUND OF THE INVENTION

1. Field of the Invention

This invention relates generally to closures for containers, and more particularly to a closure which seals a rim of an open mouth of a container at a plurality of discrete locations along the surface of the rim and container mouth where each location provides a seal over a significant portion of the surface of the container and stabilizes both the interior and exterior surfaces of the container mouth from distortion during and after installation of the closure.

2. Description of the Related Art

Closures or caps for containers typically are of the threaded screw or snap type construction and are utilized to close the mouth of the container in either a resealable or non-resealable manner. Manufacturers of products which utilize such closures typically require a closure to perform under several conditions or specifications which vary from product to product and between manufacturers.

One condition or specification is that a closure be capable of being applied to a container when the container and/or the contents therein still are hot or where the container and contents are heated after application of the closure. In such a situation, temperatures of the contents can exceed 150° which can distort the container mouth from its circular shape. Accordingly, closures utilized in such applications must not only ensure proper sealing about the container mouth or rim, but must assist in maintaining the circular shape of the container mouth during and after application of the closure.

Furthermore, containers frequently are sealed with a closure where a vacuum is provided within the container. Thus, these types of closures initially must seal the container against an inward pressure force provided by the vacuum. After opening, the same closure must then seal the container against an outward pressure force which can be provided by the weight of the container contents themselves as well as any gas pressure which may be generated by the contents, such as gas pressure provided by a carbonated beverage.

To provide a leak-proof seal about the rim of the container mouth, closures can include separate liners or be molded to include one or more rim engagement member that resists leakage of the container contents. Separate liners typically are attached to the inside closed end of the closure and can require increased manufacturing costs to insert and secure the liner to the closure and/or modify the closure to accept the liner.

An example of a closure having a molded rim engagement member is shown in U.S. Pat. No. 4,122,965 which includes one non-flexing sealing fin which projects downwardly from the closed end of the closure to engage the container rim proximate the center of the width of the rim. Such a sealing fin, however, only provides contact with the center of the rim along a single engagement line which may not provide an adequate seal, especially with container contents under pressure. Additionally, the sealing fin is crushed and deformed during installation which can restrict proper resealing of the closure upon reinstallation on the container.

U.S. Pat. No. 4,220,250 similarly discloses a closure having one sealing ring extending from an internal surface of a closure whose flexing is limited by an additional support ring depending from the closed end of the closure and which provides enhanced sealing with increased pressure within the container. A bead also is included on the internal surface of the closure side wall for locating and centering of the closure as it is finally tightened on the container. As with the closure described above, sealing is provided by a bead formed on the sealing ring that only provides contact with the center of the rim along a single engagement line. Additionally, an initial vacuum within the container may cause the structure that provides the enhanced sealing to open and enable the contents to leak out.

U.S. Pat. No. 4,360,114 discloses a closure having two resilient concentric sealing rings depending from the top portion of the cap where the outer sealing ring is longer. Both rings, however, contact the central portion of a tapered container rim and flex outward which can cause leakage from outward pressure within the container causing outward flexing of the rings.

It therefore is desirable to provide a closure which can seal a container rim, even when the container and/or contents are subjected to heat or where excess pressure or a vacuum is provided within the container, where the closure engages the container rim and mouth in a plurality of locations and provides sealing over a significant portion of the surface area of the container and which stabilizes both the interior and exterior surfaces of the container from distortion during and after installation of the closure.

SUMMARY OF THE INVENTION

The invention provides a closure for sealing a rim of an open mouth of a container. The closure includes a substantially cylindrical end cap closed at a first end thereof by a top surface, open at a second opposite end thereof and including an annular side wall having a predetermined width extending between the first and second ends. The top surface includes a first inside surface facing the interior of the end cap and a second exterior surface facing the exterior of the end cap. A first flexible seal member is connected to and depends a predetermined distance from the first inside surface of the top surface proximate the annular side wall for cooperative sealing engagement with an outer edge of the container rim and for inhibiting outward distortion of the container rim. A second flexible seal member also is connected to and depends a predetermined distance from the first inside surface of the top surface and within the confines of the first seal member for sealing engagement with an inner edge of the container rim and for inhibiting inward distortion of the container rim, the rim substantially being accepted between the first and second seal members which seal the exterior and interior edges of the rim, respectively, to prevent leakage of the container contents and contamination of the contents from elements outside of the container.

DESCRIPTION OF THE PREFERRED EMBODIMENT

Figure 2:
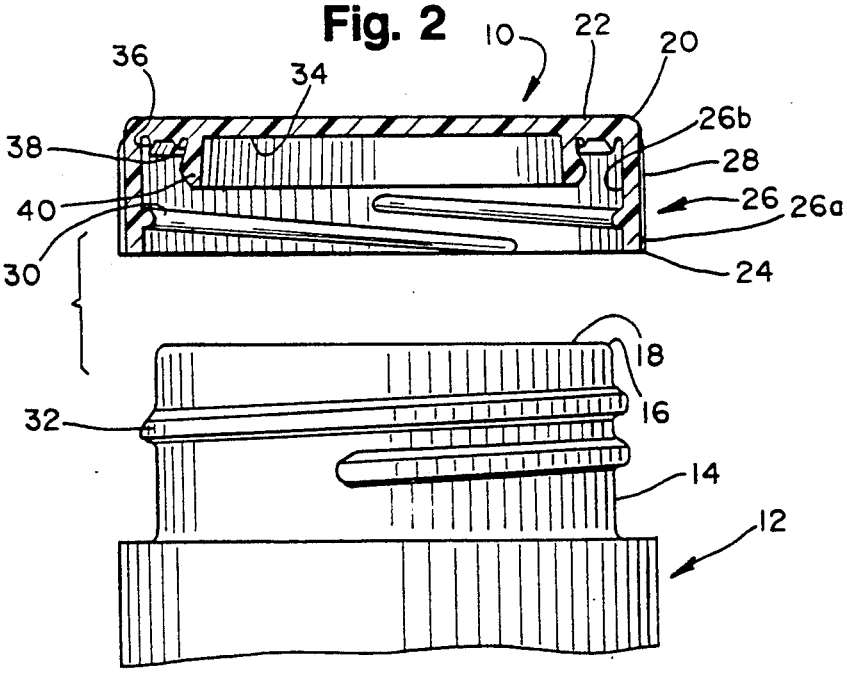
FIG. 2 is a sectional view taken along the line 2—2 of FIG. 1 in the direction indicated generally illustrating the closure in juxtaposition with a container neck and mouth illustrated in elevation.

Referring to FIG. 2, the closure or cap of the invention is designated generally by the reference numeral 10. The cap 10 preferably is made of plastic and designed for threaded engagement with a container 12 about a neck portion 14 for sealing a top rim 16 about an open mouth 18 of the container 12 as will be described below. It is to be understood, however, that the material of the cap 10 as well as the container 12 can vary and the cap 10 can be utilized in a variety of applications.

The cap 10 preferably is substantially cylindrical in shape and includes a first end 20 closed by a top surface 22, a second opposite open end 24 and an annular side wall 26 interconnecting the first end 20 and the second end 24. Preferably, to assist in gripping the outside surface of the cap 10, the exterior surface **26*a* of the annular side wall 26 can include a plurality of ribs 28. Additionally, the interior surface 26*b* of the annular side wall 26 is formed with threads 30 for cooperative threaded engagement with corresponding threads 32 on the container 12. The cap 10, however, can be designed for snap-type engagement or a combination of threaded and snap engagement with the cqntainer 12** (not illustrated) if desired.

The top surface 22 of the first closed end 20 of the cap 10 includes an interior surface 34. In order to seal the top rim 16 of the open mouth 18 of the container 12 against leakage, the interior surface 34 includes three depending concentric annular sealing flanges or fins: a first outer sealing flange 36; a second intermediate sealing flange 38 and a third inner sealing flange 40.

Figure 5:
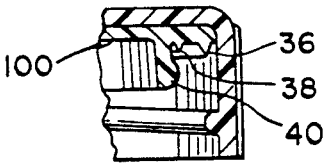
FIG. 5 is an enlarged cross-sectional view of a portion of the cap of the invention illustrating a separate liner.

Preferably, the three flanges 6, 8 and 40 are somewhat flexible and ere integrally formed with and depend outwardly away from the interior surface 34. It is to be understood, however, that the three flanges 36, 38 and 40 may be of any shape and size, may not be annular and could be provided in the form of one or more separate assemblies or liners, such as liner 100 in FIG. 5, which then are secured to the interior surface 34, if desired.

Figure 4:
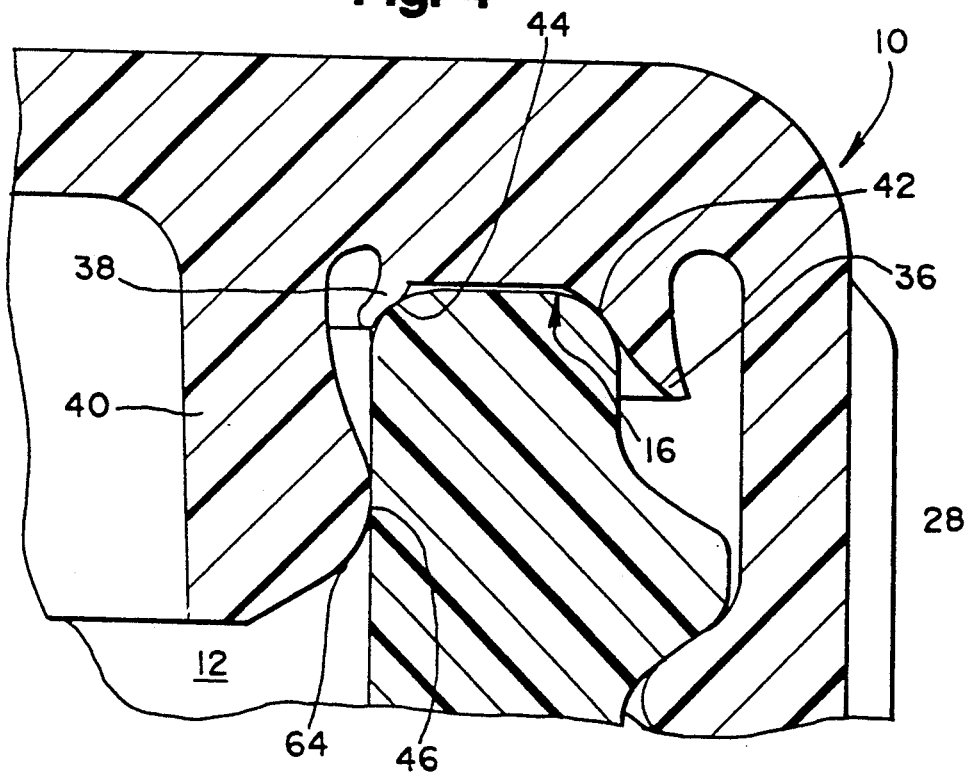
FIG. 4 is an enlarged fragmentary sectional view of the closure of the invention, similar to FIG. 3, illustrating the sealing members after engagement with the container rim and sealing thereof.

Briefly, as FIG. 4 illustrates, in operation when the cap 10 is threadedly applied to the container 12, the first outer flange 36 seals an outer edge 42 of the top rim 16 of the container 12 and the second intermediate flange 38 seals an inner edge 44 of the top rim 16. The third inner flange 40 seals an inside surface 46 of the neck 14 of the container 12. Details of the sealing of the three flanges 36, 38 and 40 will be discussed hereinafter.

Figure 3:
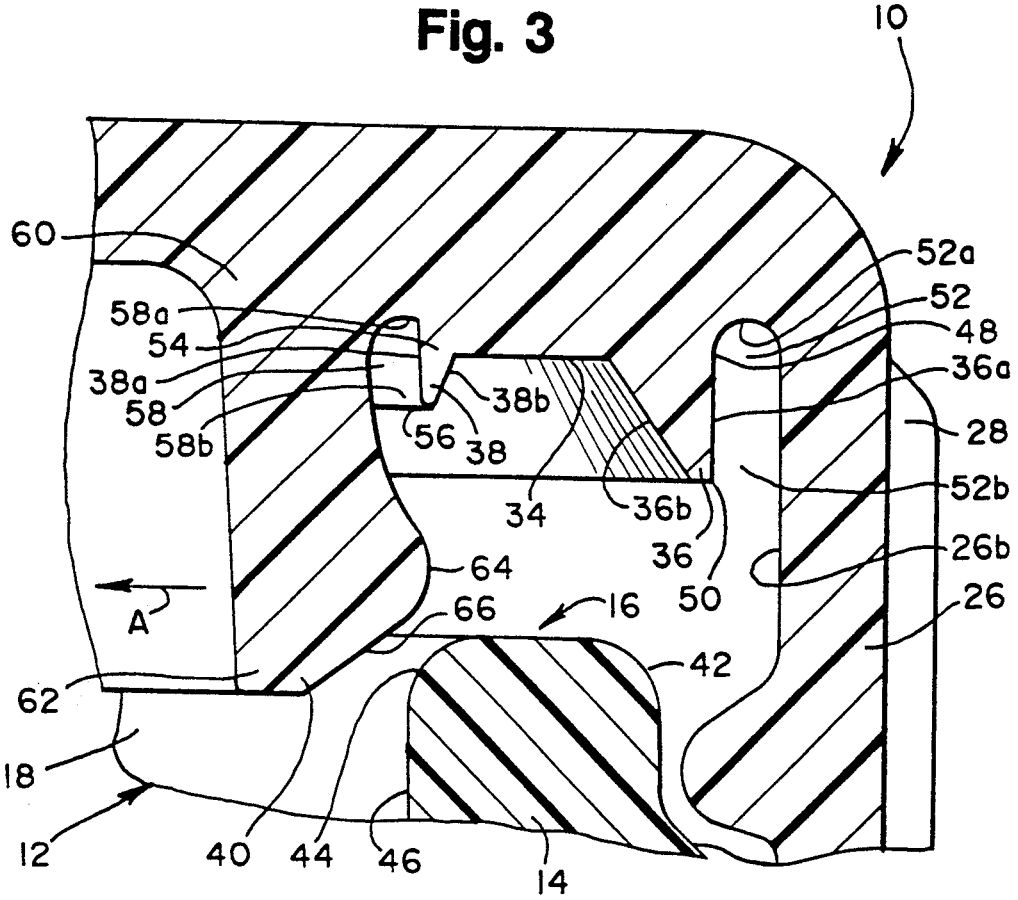
FIG. 3 is an enlarged fragmentary sectional view of the closure of the invention illustrating the sealing members prior to engagement with a container rim.

As FIG. 3 illustrates, the first outer flange 36 substantially is triangular in cross-sectional configuration and forms an annular fin or ring depending from the interior surface 34 of the cap 10. The first outer flange 36 includes a first proximal end 48, connected to the interior surface 34 of the cap 10, and a second opposite distal end 50, formed at a distance from the first proximal end 48. Thus, the second distal end 50 depends a predetermined distance outwardly away from the interior surface 34 of the cap 10 to provide the desired engagement with the outer edge 42 of the rim 16.

Preferably, to allow for outward flexing of the first outer flange 36 within the confines of the cap, 10, the first flange 36 includes a first outside surface **36*a* and a second tapered inside surface 36*b* which tapers from the first proximal end 48 to the second distal end 50 of the first outer flange 36**.

The first outside surface **36*a* is spaced a predetermined distance from the interior surface 26*b* of the annular side wall 26 of the cap 10 by a first annular slot 52 having a length extending substantially parallel to the interior surface 26*b*. The first slot 52 has a first closed end 52*a* and a second open end 52*b* which opens to the interior of the cap 10 facing the second open end 24 of the cap 10. It is to be noted that the first closed end 52*a* is rounded and extends into the interior surface 34 of the cap 10 a predetermined distance to assist in flexing of the first flange 36 and provide a point of rotation for the first flange 36**.

Similarly, the second intermediate flange 38 substantially is triangular in cross-sectional configuration and forms an annular fin or ring depending from the interior surface 34 of the cap 10. The second flange 38 includes a first proximal end 54, connected to the interior surface 34 of the cap 10, and a second opposite distal end 56, formed at a distance from the first proximal end 54. Thus, the second distal end 56 depends a predetermined distance outwardly away from the interior surface 34 of the cap 10 to provide the desired engagement with the inner edge 44 of the rim 16.

Preferably, the first outer flange 36 is somewhat longer than the second intermediate flange 38, but the lengths of both the first and second flanges 36 and 38 can vary. To allow for inward flexing of the second flange 38 within the confines of the cap 10, the second flange 38 includes a first surface **38*a* and a second tapered surface 38*b* which tapers from the first proximal end 54 to the second distal end 56 of the second intermediate flange 38**.

The first surface **38*a* is spaced a predetermined distance from the third interior flange 40 by a second annular slot 58 having a length extending substantially normal to the interior surface 34 of the cap 10. The second slot 58 includes a first closed end 58*a* and a second open end 58*b* which opens to the interior of the cap 10 facing the second open end 24 of the cap 10. The first closed end 58*a* is rounded and extends into the interior surface 34 of the cap 10 a predetermined distance to assist in flexing of the second flange 38 and provide a point of rotation for the second flange 38**.

The third inner flange 40 forms an annular fin or ring depending from the interior surface 34 of the cap 10 and includes a first proximal end 60, connected to the interior surface 34, and a second opposite distal end 62, formed at a distance from the first proximal end 60. Thus, the second distal end 62 depends a predetermined distance outwardly away from the interior surface 34 and preferably is longer than both the first and second flanges 36 and 38 for contact with the interior surface 46 of the neck 14 of the container 12.

To provide contact between the third inner flange 40 and the interior surface 46 of the neck 14, the third flange 40 includes an outwardly extending rounded shoulder 64. As FIG. illustrates, before the cap 10 is installed on the container 12 the shoulder 64 is positioned proximate the proximal end 60 of the flange 40 and extends outwardly toward both the first and second flanges 36 and 38 and the annular side wall 26 of the cap 10 to project over the second flange 38. To assist in seating and flexing of the flange 40 as will be described below, the shoulder 64 tapers off along a ramp portion 66 toward the distal end 62 of the flange 40.

As FIG. 3 illustrates, as the cap 10 is installed on the container 12, the ramp portion 66 of the shoulder 64 initially will contact the inner edge 44 of the rim 16. Upon continued installation, the contact between the ramp portion 66 and the inner edge 44 of the rim 16 will force the third flange 40 to the left in the direction of arrow "A" until the shoulder 64 occupies the position illustrated in FIG. 4 where it is spring loaded against the inside surface 46 of the neck 14.

As the third flange 40 is being flexed, the outer and inner edges 42 and 44 of the rim 16 engage the first and second flanges 36 and 38, respectively, which then are flexed in opposite directions. This flexing is accomplished due to the shape of the outer and inner edges 42 and 44 and the flexibility and shape of the first and second flanges 36 and 38 which allows the rim 16 of the container 12 to occupy the final sealed position with respect to the cap 10 as illustrated in FIG. 4.

In this final sealed position, all three flanges 36, 38 and 40 provide sealing engagement along a substantial surface area of the container 12 as opposed to mere line contact. Furthermore, sealing is provided against both an inward pressure provided by a vacuum or an outward pressure provided by the weight of the container contents or gas pressure generated by the container contents.

It also is to be noted that the cooperation between flanges 36, 38 and 40 helps to stabilize both the inside and outside portions of the mouth 18 of the container 12 and prevent it from distorting. This is especially important when the container 12 or the contents are heated before or after application of the cap 10.

Additionally, the design of the flanges 36, 38 and 40 enables a cap 10 to be utilized with a range of sizes and tolerances of the mouth 18 and rim 16, which can have edges 42 and 44 of different shapes including squared off edges (not illustrated.) This is due to the flexibility of the flanges 36, 38 and 40, the use of the tapered surfaces **36*b* and 38*b* of the flanges 36 and 38, slots 52 and 58 and the cooperative engagement with the rim 16**.

Figure 1:
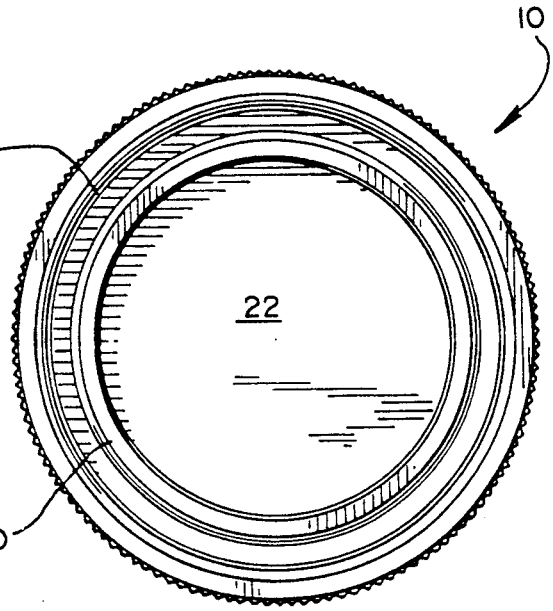
FIG. 1 is a bottom plan view of a closure illustrating the sealing members of the invention formed on the inside top surface thereof.
Figure 6:
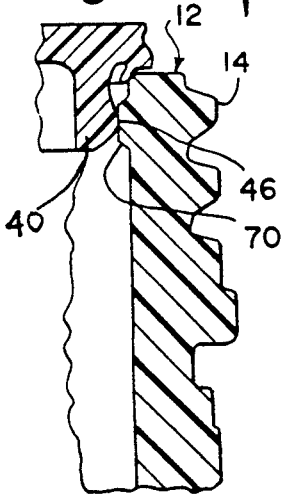
FIG. 6 is an enlarged cross-sectional view of a portion of the container mouth illustrating another feature of the invention.

As FIG. 6 illustrates, in order to minimize the drag of the third inner flange 40 against the inside surface 46 of the neck 14 of the container 12, the inside surface 46 can be enlarged in diameter and formed to include an internal rib 70. Thus, when the cap 10 is installed on the container 12, the third inner flange 40 does not deflect in the direction of arrow "A" until it engages the internal rib 70. This engagement also enables more thread contact area between the cap 10 and container 12.

Modification and variations of the present invention are possible in light of the above teachings. It is therefore to be understood that within the scope of the appended claims, the invention may be practiced otherwise than as specifically described.

What is claimed and desired to be secured by letters patent of the United States is:

1. A closure for sealing a rim of an open mouth of a container, the rim having a top surface, an outside surface, an inside surface, a first transitional corner between said top surface and said outside surface and a second transitional corner between said top surface and said inside surface, the closure comprising:

a substantially cylindrical end cap closed at a first end thereof by a top surface, open at a second opposite end thereof and including an annular side wall having a predetermined width extending between said first and second ends, said top surface including a first inside surface facing an interior of said end cap and a second exterior surface facing an exterior of said end cap;

first flexible seal means connected to and depending a predetermined distance from said first inside surface of said top surface proximate said annular side wall for cooperative sealing engagement with said first corner of said container rim and for inhibiting outward distortion of said container rim and a space defined between said side wall and said first seal means;

second flexible seal means connected to and depending a predetermined distance from said first inside surface of said top surface and within the confines of said first seal means for cooperative sealing engagement with said second corner of said container rim and for inhibiting inward distortion of said container rim, said first and second seal means forming a channel therebetween for receiving said container rim therein to prevent leakage of container contents, contamination of the contents from elements outside the container and inhibiting outward and inward distortion of the container rim;

third flexible seal means connected to and depending a predetermined distance from said first inside surface of said top surface and within the confines of said second seal means for sealing engagement with an internal surface of the container mouth and for inhibiting inward distortion of a container neck, and a space defined between said second seal means and said third seal means; and said channel being radially larger than the space between the side wall and the first seal means, and said channel being radially larger than the space between the second seal means and the third seal means, the first and second seal means being sufficiently spaced from the side wall and the third seal means, respectively, so that they remain free of contact with the side wall and third seal means at all times.

2. The closure as defined in claim 1 wherein said first, second and third seal means are annular.

3. The closure as defined in claim 1 wherein said first and second seal means provide sealing engagement over a predetermined portion of a surface area of said container.

4. The closure as defined in claim 1 wherein said first, second and third seal means provide sealing engagement over a predetermined portion of a surface area of said first and second corners of said container rim and said inside surface, respectively.

5. The closure as defined in claim 1 wherein said first and second seal means are integrally formed with said first inside surface of said top surface of said end cap.

6. The closure as defined in claim 1 wherein said first and second seal means are formed as at least one separate liner member which is connected to said first inside surface of said top surface of said end cap.

7. The closure as defined in claim 1 wherein said first, second and third seal means are integrally formed with said first inside surface of said top surface of said end cap.

8. The closure as defined in claim 1 wherein said first, second and third seal means are formed as at least one separate liner member which is connected to said first inside surface of said top surface cf said end cap.

9. The closure as defined in claim 1 wherein said internal surface includes an annular rib for sealing engagement with said third seal means.

10. A container and a closure for sealing a rim of an open mouth of said container, the container rim having a substantially horizontal top surface, a substantially vertical outside surface, a substantially vertical inside surface, a first substantially arcuate curved transitional corner between said top surface and said outside surface and a second substantially arcuate curved transitional corner between said top surface and said inside surface, the closure comprising:

a substantially cylindrical end cap closed at a first end thereof by a top surface, open at a second opposite end thereof and including an annular side wall having a predetermined width extending between said first and second ends, said top surface including a first inside surface facing an interior of said end cap and a second exterior surface facing an exterior of said end cap;

first flexible seal means connected to and depending a predetermined distance from said first inside surface of said top surface proximate said annular side wall for cooperative sealing engagement with said first corner of said container rim and for inhibiting outward horizontal distortion of said container rim; and second flexible seal means connected to and depending a predetermined distance from said first inside surface of said top surface and within the confines of said first seal means for cooperative sealing engagement with said second corner of said container rim and for inhibiting inward radial distortion of said container rim, said first and second seal means forming a channel therebetween for receiving said container rim therein to prevent leakage of container contents, contamination of the contents from elements outside the container and inhibiting outward and inward radial distortion of the container rim; and third flexible seal means connected to and depending a predetermined distance from said first inside surface of said top surface and within the confines of said second seal means for sealing engagement with said substantially vertical inside surface of said container rim and for inhibiting inward radial distortion of said container rim.

11. The container and closure as defined in claim 10, wherein said final position of said container rim with respect to said closure is spaced from said annular side wall of said closure.

* * * * *

UNITED STATES PATENT AND TRADEMARK OFFICE

CERTIFICATE OF CORRECTION

PATENT NO. : 5,297,688

DATED : March 29, 1994

INVENTOR(S) : James M. Beck, Terry E. Kubitz and Alex Kutaj

It is certified that error appears in the above-indentified patent and that said Letters Patent is hereby corrected as shown below:

Column 3, line 49, change "6, 8" to --36, 38--;

Column 3, line 50, change "ere" to --are--;

Column 5, line 2, after "FIG." insert --3--;

Column 6, line 18, after "rim" insert a comma (,).

Signed and Sealed this

Nineteenth Day of July, 1994

*Attest:*

*Attesting Officer*

BRUCE LEHMAN

*Commissioner of Patents and Trademarks*